204-44.3 AU 112 EX
10/7/86 OR 4,615,774

United States Patent [19]
Somers et al.

[11] Patent Number: 4,615,774
[45] Date of Patent: Oct. 7, 1986

[54] GOLD ALLOY PLATING BATH AND PROCESS

[75] Inventors: Gerardus A. Somers, Schayk; John R. Lovie, Hertogenbosch; Jan J. M. Hendriks, Sint Oedenrode, all of Netherlands

[73] Assignee: OMI International Corporation, Warren, Mich.

[21] Appl. No.: 696,932

[22] Filed: Jan. 31, 1985

[51] Int. Cl.[4] ..... C25D 3/62
[52] U.S. Cl. ..... 204/44.3
[58] Field of Search ..... 204/44.3, 47.5, 123

[56] References Cited

U.S. PATENT DOCUMENTS 3,475,290 10/1969 Yamamura et al. ..... 204/44.3
4,069,113 1/1978 Crossley et al. ..... 204/44.3

*Primary Examiner*—G. L. Kaplan
*Attorney, Agent, or Firm*—Richard P. Mueller

[57] ABSTRACT

A citrate-free electroplating bath for the high speed deposition of gold alloy plates on substrates comprises a source of gold (for example gold (I) potassium cyanide), a source of alloying metal (for example, nickel sulfate), oxalic acid and formic acid. As citrate is not used, higher plating speeds are obtained and precipitates of certain citrate salts (for example, nickel citrate) are avoided.

15 Claims, No Drawings

GOLD ALLOY PLATING BATH AND PROCESS

BACKGROUND OF THE INVENTION

This invention relates to a bath for electroplating gold alloys and more particularly to a bath for the high speed plating of a hardened gold alloy.

It is known to co-deposit various metals with gold during electrodeposition to give a harder electrodeposit than is achievable with pure gold. It is usual for a complexing agent for the alloying metal to be present and in a known gold-cobalt plating bath, citrate is present as a complexing agent and as a buffering agent for the bath.

It might be expected that a bath for the electrodeposition of a gold-nickel alloy might be derivable from a bath for the electrodeposition of a gold-cobalt alloy merely by replacing the source of cobalt with a source of nickel. However, if this is tried, it is found that the plating speed is impaired and that unwanted precipitates are obtained in the bath.

SUMMARY OF THE INVENTION

It has surprisingly been found that citrate appears to be the agent responsible for these deficiencies, especially when the bath is for depositing gold-nickel alloys.

In accordance with the present invention, there is, therefore, provided a citrate-free bath for the electrodeposition of a gold alloy, the bath comprising a bath soluble source of gold, a bath soluble source of alloying metal, oxalic acid and formic acid.

It will be understood that throughout the specification reference to a weak organic acid (such as oxalic acid or formic acid) and its anion are used interchangeably: the nature of the species present will, of course, depend on the pH of the bath.

DETAILED DESCRIPTION OF THE INVENTION

The bath soluble source of gold is preferably a gold (I) salt, which could, for example, be an alkali metal gold (I) cyanide or ammonium gold (I) cyanide. The gold may be present in an amount of from 4 to 50 g/l, preferably 4 to 20 g/l, for example 8 to 12 g/l.

It is particularly preferred that the alloying metal be nickel. In such case, the bath soluble source of alloying metal preferably comprises nickel sulfate. The nickel may be present in an amount of from 0.5 to 20 g/l, preferably 1 to 5, for example 2 to 3 g/l.

The oxalic acid is believed to have two primary functions in the bath. First, it is believed to act as a complexing agent for the nickel ions; secondly, it acts as a buffering agent for the bath. The oxalic acid will, therefore, normally be present in an amount sufficient for it to fulfill these functions. When choosing the amount of oxalic acid to be used, the relatively limited solubility of the acid at lower temperatures must be taken into account. Preferred baths in accordance with the invention are those in which oxalic acid is present in an amount of from 20 to 100 g/l, preferably 30 to 80 g/l, for example 40 to 60 g/l. More specifically, the oxalic acid may be present in an amount from 45 to 55 g/l, for example 50 g/l, which was found to be the most suitable concentration for use. Small variations of oxalic acid concentration around this level have hardly any effect on the plating speed at which the bath may be operated.

The formic acid is believed to be an essential ingredient for obtaining high plating speeds. It appeared to operate as an anti-burning agent or an inhibitor for metal transport in the high current density areas. The formic acid may be present in an amount of from 20 to 100 ml/l, preferably 30 to 80 ml/l, although from 30 to 40 ml/l appeared to be the optimum concentration range. A particularly preferred concentration of formic acid was 35 ml/l.

A pH adjusting agent, for example potassium hydroxide or another alkali metal hydroxide, may be present in the bath, preferably in an amount which will provide a final bath pH of from 3.9 to 5.1, more particularly 4.1 to 4.9.

Although it is not necessary for the bath to contain any further ingredients, other additives may be used to modify and/or further improve brightness, ductility, grain refinement and the like. Components for these and other purposes, as are conventional in the art, may be added in accordance with known practices. In doing so, however, the components added must be compatible with the other bath components and not have any adverse effect on the bath or its operation.

Additionally, in accordance with the present invention, there is provided a process for plating gold alloy, particularly gold nickel, on a substrate, especially at high speed. The process comprises immersing the substrate to be plated as a cathode in a bath in accordance with the present invention and passing current between the cathode and an anode in the bath.

The bath may be operated at a temperature of from 20° C. to 80° C., preferably 30° to 70° C., for example 40° to 60° C.

After plating, the duly plated substrate is preferably rinsed in softened or deionized water so as to avoid deposits of calcium oxalate.

In laboratory scale plating processes carried out in accordance with the invention in agitation equipment, it was found that plating speeds of 3.8 microns per minute at current densities of 13 ASD could be achieved without loss of brightness. With the use of suitable equipment with higher solution and handling capabilities, for example, jet plating, much higher plating speeds at much higher current densities (up to 200 ASD) can be achieved.

Baths in accordance with the present invention are particularly suitable for use in high speed plating. In such commercial use of baths of the invention, current densities of from 10, 20, 50 or 100 to 200 ASD may be used to take advantage of the high speed plating potential of the baths. When plating at high speeds, it is generally desirable to agitate the solution, preferably to achieve such a high level of agitation that the solution is turbulent.

For a better understanding of the invention, the following non-limiting examples are given.

EXAMPLE 1

A bath having the following composition was made up;

| INGREDIENT | AMOUNT |
|---|---|
| Gold as potassium gold (I) cyanide | 10 g/l |
| Oxalic acid $2H_2O$ | 63 g/l |
| Formic acid | 40 ml/l |
| Nickel (as sulfate) | 2 g/l |
| Potassium hydroxide | to pH 4.1 |
| Distilled Water | to 1 liter |

The bath formulated as above was placed in a laboratory scale turbulent agitation plating system. Electrolyte was pumped through two pipes into a 500 ml/l beaker and was directed through holes in the pipes onto the substrate, which was immersed as a cathode in the beaker. Electrolyte solution was pumped away through a third pipe in the beaker. The cathode is located between the two supply pipes and anodes are placed around the supply pipes at such a position that they do not disturb the solution flow.

The solution is pumped around the system at a flow rate of 5 liters per minute (measured with water at room temperature).

It was found that fully bright gold nickel electrodeposits up to about 5 microns in thickness were deposited from the above bath at a deposition rate of 3.8 microns per minute, using a current density up to 13 ASD.

EXAMPLE 2

An electrolyte bath having the following composition was prepared:

| INGREDIENT | AMOUNT |
|---|---|
| Gold as potassium gold (I) cyanide | 10 g/l |
| Oxalic acid $2H_2O$ | 50 g/l |
| Formic acid | 35 ml/l |
| Nickel (as sulfate) | 3 g/l |
| Potassium hydroxide | to pH 4.4 |
| Distilled Water | to 1 liter |

Under the conditions described from Example 1, it was found that fully bright gold-nickel electrodeposits were obtained at a deposition rate of 3.75 microns per minute using a current density of up to 12 ASD.

EXAMPLE 3

With a bath as described above in Example 2, except that 20 ml/l formic acid and 2 g/l nickel were used, fully bright deposits were obtained at a plating speed of 2.5 microns per minute at a current density of 8 ASD. Fully bright deposits were also obtained at a plating speed of 2.8 microns per minutes (9 ASD) and 3.1 microns per minute (10 ASD). In all cases, the temperature of the bath was 50° C.

EXAMPLE 4

Using an electroplating bath as prepared in Example 2, except that the concentration of formic acid was 40 ml/l and the concentration of nickel was 2.0 g/l, fully bright deposits of gold-nickel alloy were obtained at a plating speed of 3.0 microns per minute with a current density of 10 ASD. Fully bright deposits were also obtained at plating speeds of 3.3 microns per minute (11 ASD) and 3.55 microns per minute (12 ASD). In all cases the bath temperature was 50° C.

It will be further understood that the examples set forth above are illustrative only, and that they are subject to further changes and modifications without departing from the broader aspects of this invention.

What is claimed is:

1. A citrate-free bath for the electrodeposition of a gold alloy, which bath consists essentially of a bath soluble source of gold in an amount to provide a gold content of 4 to 50 g/l, a bath soluble source of nickel alloying metal in an amount to provide a nickel content of 0.5 to 20 g/l, oxalic acid in an amount of 20 to 100 g/l, and formic acid in an amount of 20 to 100 ml/l.

2. A bath as claimed in claim 1, wherein the bath soluble source of gold comprises a gold (I) salt.

3. A bath as claimed in claim 2, wherein the gold (I) salt is an alkali metal or ammonium gold (I) cyanide.

4. A bath as claimed in claim 1, in which the gold is present in an amount of from 4 to 20 g/l.

5. A bath as claimed in claim 1, wherein the bath soluble source of nickel comprises nickel sulfate.

6. A bath as claimed in claim 1, in which the nickel is present in an amount of from 1 to 5 g/l.

7. A bath as claimed in claim 1, in which the oxalic acid is present in an amount of from 40 to 60 g/l.

8. A bath as claimed in claim 1, in which the formic acid is present in an amount of from 30 to 40 ml/l.

9. A bath as claimed in claim 1, in which there is also present a pH adjuster.

10. A bath as claimed in claim 9, wherein the pH adjuster is potassium hydroxide.

11. A bath as claimed in claim 1, wherein the pH of the bath is from 3.9 to 5.1.

12. A bath as claimed in claim 11, in which the pH of the bath is from 4.1 to 4.9.

13. A process for plating gold alloy on a substrate, the process comprising immersing the substrate to be plated as a cathode in a bath as claimed in claim 1 and passing current between the cathode and an anode in the bath, to deposit gold on said cathode.

14. A process as claimed in claim 13, wherein said deposition of gold is carried out at a current density up to 200 ASD.

15. A process as claimed in claim 14, the plating bath has a pH of from 3.9 to 5.1 and contains an alkali metal gold cyanide in an amount to provide a gold content of from 4 to 50 g/l, nickel sulfate in an amount to provide a nickel content of from 0.5 to 20 g/l, oxalic acid in an amount of from 20 to 100 g/l, and formic acid in an amount of from 20 to 100 ml/l.

* * * * *